US005785559A

United States Patent [19]

Meyer et al.

[11] Patent Number: 5,785,559

[45] Date of Patent: Jul. 28, 1998

[54] CONNECTOR ASSEMBLY WITH CODED SECONDARY LOCKING MECHANISM

[75] Inventors: Jürgen Meyer, Pfaffenhofen; Hans-Joachim Zander, Schifferstadt; Dirk Duenkel, Bensheim; Franz-Josef Thiel, Weiterstadt, all of Germany

[73] Assignee: The Whitaker Corporation, Wilmington, Del.

[21] Appl. No.: 959,103

[22] Filed: Oct. 23, 1997

Related U.S. Application Data

[63] Continuation of Ser. No. 522,043, Aug. 31, 1995, abandoned.

[51] Int. Cl.[6] ..... H01R 13/64

[52] U.S. Cl. ..... 439/680

[58] Field of Search ..... 439/677, 678, 439/679, 680, 681, 595

[56] References Cited

U.S. PATENT DOCUMENTS

| | | | |
|---|---|---|---|
| 3,818,420 | 6/1974 | Barr | 439/680 |
| 4,232,930 | 11/1980 | Teti | 439/680 |
| 4,284,320 | 8/1981 | Nix et al. | 339/200 |
| 4,923,413 | 5/1990 | Michaels | 439/680 |
| 4,959,023 | 9/1990 | Watanabe et al. | 439/595 |
| 5,066,253 | 11/1991 | Kameyama | 439/752 |
| 5,127,854 | 7/1992 | Fujitani et al. | 439/595 |
| 5,370,556 | 12/1994 | Olsson | 439/680 |
| 5,389,014 | 2/1995 | Kümpel et al. | 439/752 |

FOREIGN PATENT DOCUMENTS

| | | | |
|---|---|---|---|
| 0 191 776 B1 | 8/1986 | European Pat. Off. | H01R 13/436 |
| 2 692 407 A1 | 12/1993 | France . | |
| 40 30 621 A1 | 4/1991 | Germany . | |

*Primary Examiner*—Hien Vu

*Attorney, Agent, or Firm*—Bradley N. Ditty

[57] ABSTRACT

A connector assembly comprises a housing and a secondary locking member for coupling to a complementary connector assembly comprising a housing and a secondary locking member. The housing comprises a central coding cavity that allows insertion therethrough of prismatic coding bars that extend from the secondary locking member. The complementary connector housing similarly comprises a through cavity to allow passage therein of a coding bar of the secondary locking member that is complementary to the coding bar. The secondary locking member can be assembled to the connector housing within a shroud in a preassembled position and then shifted in the direction D to the fully assembled locked position. Similarly, the secondary locking member of the complementary connector can be inserted in the shroud in a preassembled position and then shifted in the direction of arrow D to the fully locked position. When both secondary locking members are fully locked to their respective housings, the connector assemblies can then be mated whereby the coding bars are inserted into the coding cavity of the mating connector housing thereby interleaving with the complementary coding bar. The coding bars thus perform the functions of coding and of preventing coupling of connector assemblies if the secondary locking members are not fully locked. Furthermore, integral moulding of the coding bars to the secondary locking mechanism provides a sturdy and reliable coding system with many possibilities.

15 Claims, 5 Drawing Sheets

CONNECTOR ASSEMBLY WITH CODED SECONDARY LOCKING MECHANISM

This application is a Continuation of application Ser. No. 08/522,043 filed Aug. 31, 1995, now abandoned.

BACKGROUND OF THE INVENTION

1. Field of the Invention

This invention relates to a connector assembly having a secondary locking mechanism and a coding mechanism for ensuring coupling to the correct complementary assembly, wherein the coding member is incorporated on the secondary locking mechanism.

2. Description of the Prior Art

It is common to find electrical connector assemblies comprising a first insulative housing for receiving electrical terminals therein, and further member comprising a movable secondary locking mechanism that can be activated from a pre-assembly to a fully assembled position to securely lock the terminals within the housing once they have been fully inserted thereinto. It is also known to provide coding means between mating connectors to ensure that the correct connectors are coupled together. It is however a continuous requirement to increase the cost-effectiveness, reliability and robustness of electrical connectors. It is also desirable to provide a large number of coding possibilities for certain applications. Furthermore, many connectors must enable reliable sealing due to the harsh environments in which some are placed, for example in automotive applications.

SUMMARY OF THE INVENTION

It is therefore an object of this invention to provide a connector assembly for mating with a complementary connector assembly, having a secondary locking means for securely locking terminals therein, and a coding means for preventing coupling of the connector assembly to the complementary connector assembly, when the secondary locking member is not fully assembled, in a robust, reliable and cost-effective manner.

It is a further object of this invention to provide a compact coding system for a connector assembly that allows a large number of coding combinations, in a reliable and cost-effective manner.

The objects of this invention have been achieved by providing a connector assembly comprising an insulative housing and a secondary locking mechanism mountable thereto in a pre-assembly position for receiving terminals in the housing, and movable to a fully assembled position such that the terminals are securely locked within the housing, the connector assembly further comprising coding means interengageable with coding means of a complementary connector assembly matable therewith, wherein the coding means is an integral extension of the secondary locking mechanism. The extension may have a prismatic, coded shape insertable into a code member receiving cavity of the housing such that the complementary code means of the complementary code assembly is insertable into the remaining space in the code member receiving cavity adjacent the code member. The secondary locking mechanism can be mounted from a terminal receiving face whereby the coding means is substantially centrally positioned such that a sealing surface around the mating face of the connector is unbroken. The latter thus enables easy and effective sealing of this connector whilst nevertheless providing secondary locking.

Figure 1:
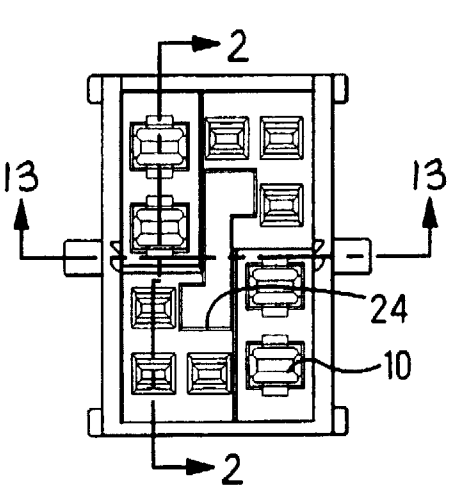
FIGS. 1–3 are top, cross-sectional and bottom views of a tab terminal receiving housing.
Figure 2:
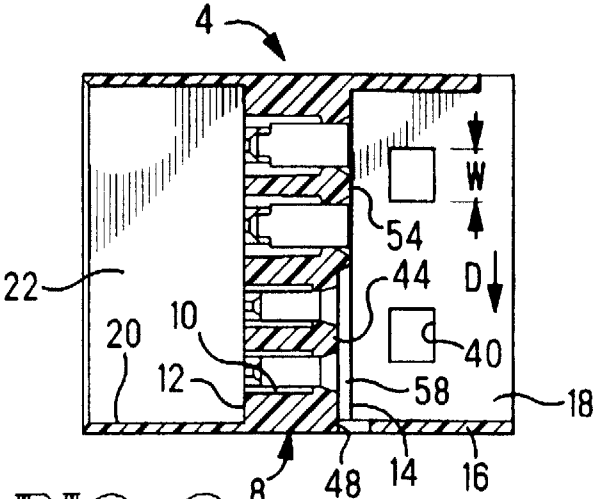
Figure 3:
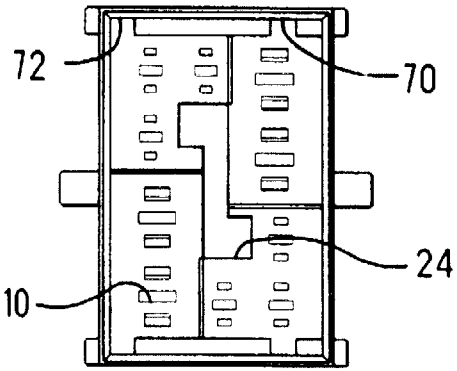
Figure 5:
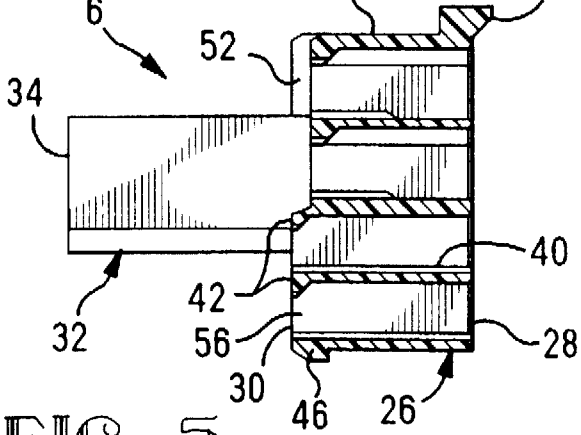
FIGS. 4–6 are top, cross-sectional and bottom views of a secondary locking and coding member for assembly to the housing of FIG. 1–3.
Figure 6:
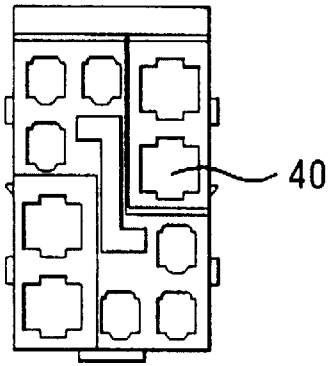
Figure 4:
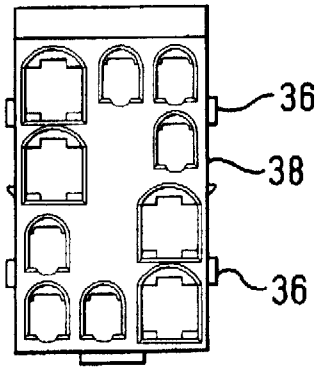
Figure 9:
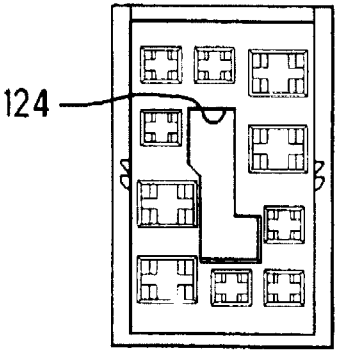
FIGS. 7–9 are top, cross-sectional and bottom views respectively of a housing of a complementary receptacle connector assembly for mating with the connector assembly of FIGS. 1–6.
Figure 12:
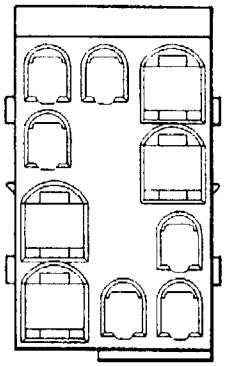
FIGS. 10–12 are top, cross-sectional and bottom views respectively of a secondary locking and coding mechanism for assembly to the housing of FIGS. 7–9.
Figure 8:
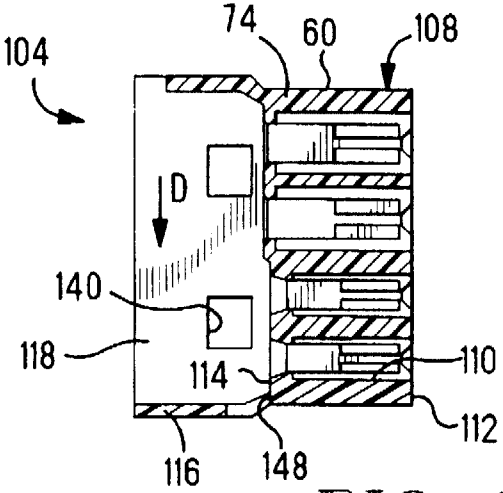
Figure 11:
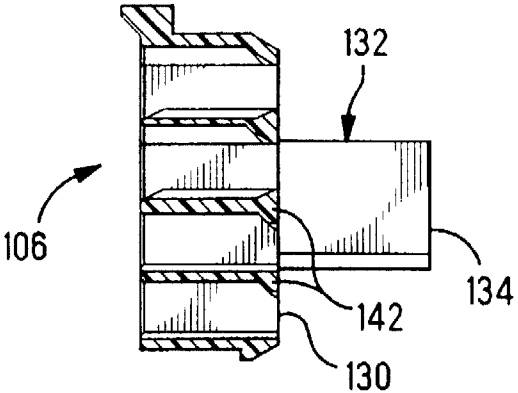
Figure 7:
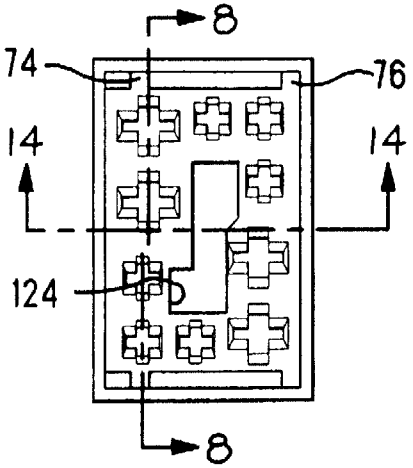
Figure 10:
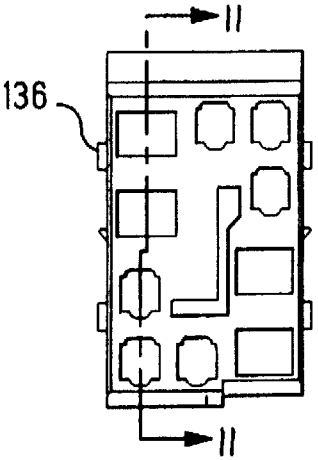
Figure 13:
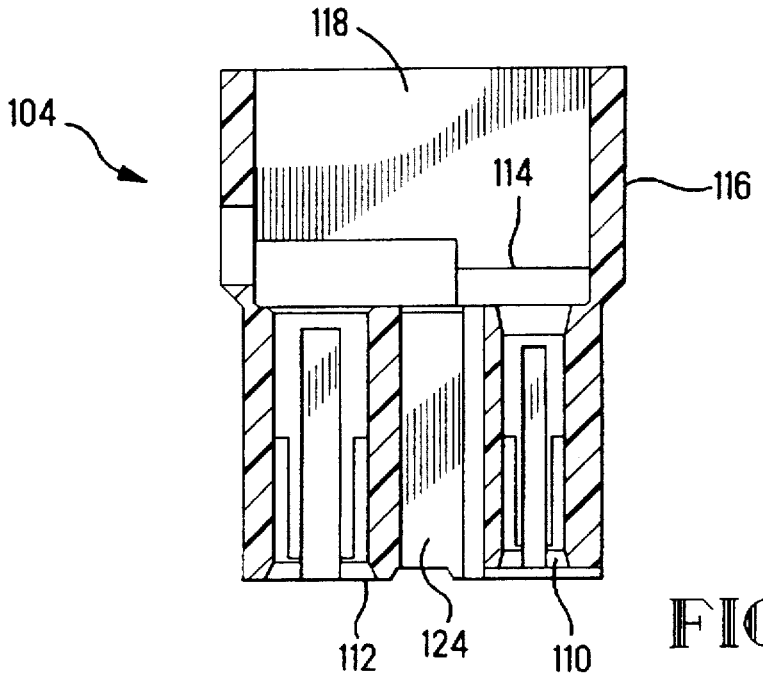
FIG. 13 is a cross-sectional view through lines 13—13 of FIG. 1.
Figure 14:
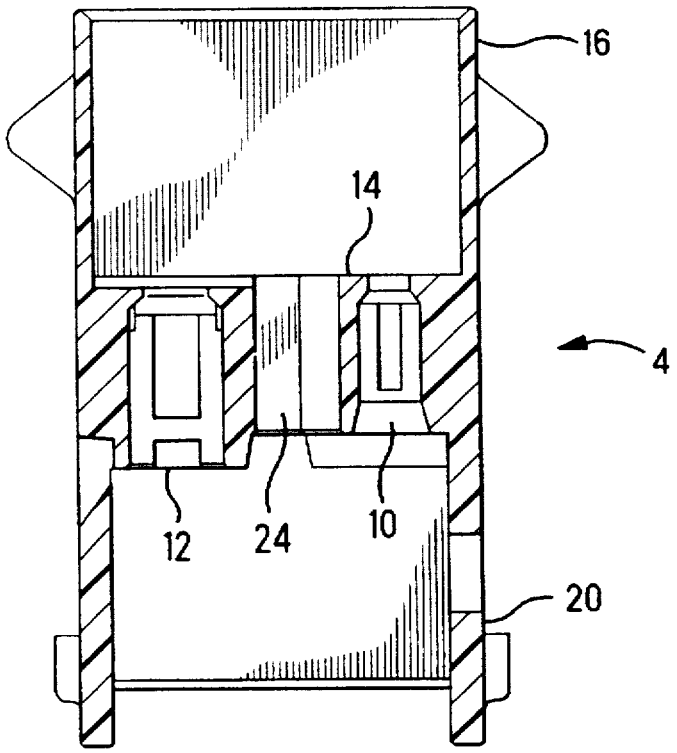
FIG. 14 is a cross-sectional view through lines 14—14 of FIG. 7.
Figure 15:
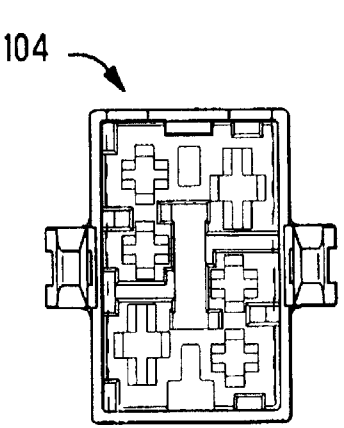
FIG. 15 is a top view of a receptacle terminal housing.
Figure 16A:
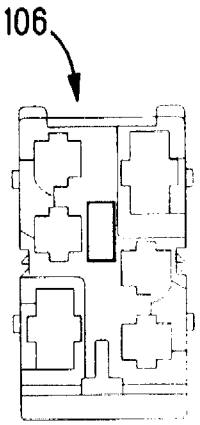
Figure 16B:
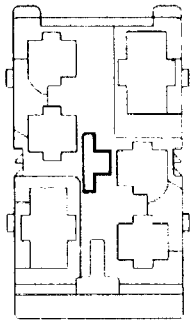
Figure 16C:
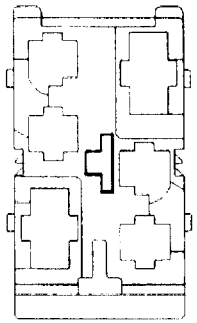
Figure 16D:
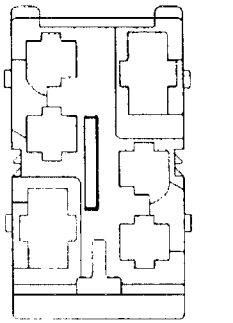
Figure 16E:
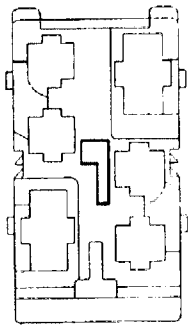
Figure 16F:
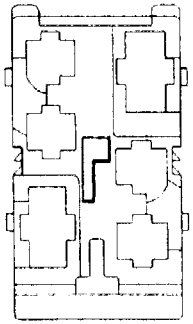
Figure 16G:
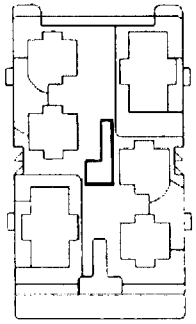
Figure 16H:
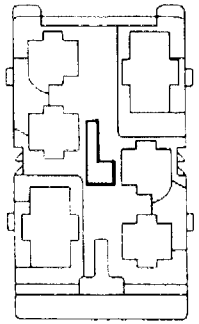
Figure 17:
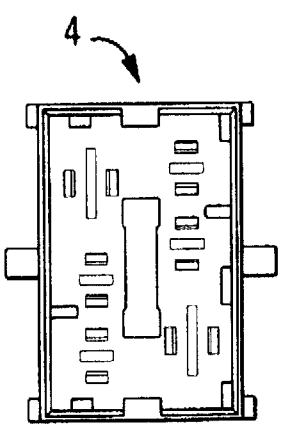
Figure 18A:
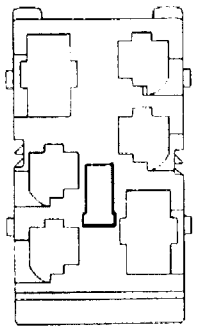
Figure 18B:
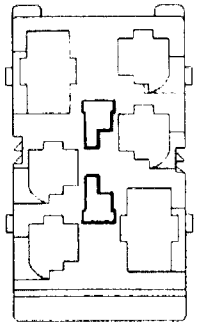
Figure 18C:
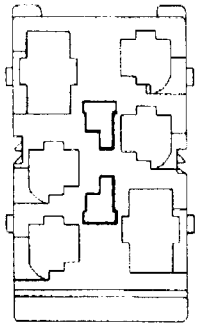
Figure 18D:
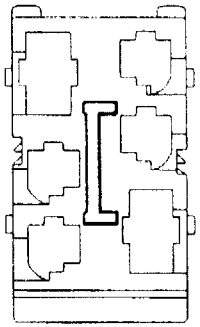
Figure 18E:
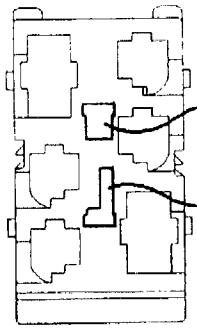
Figure 18F:
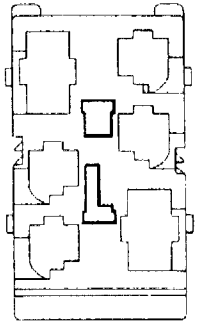
Figure 18G:
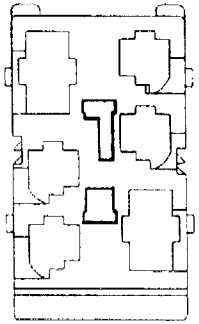
Figure 18H:
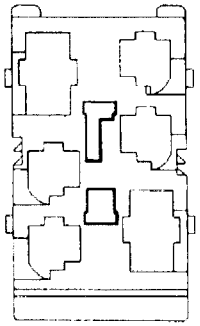

FIGS. **16*a*–16*h* are top views of various secondary locking mechanisms having different coding bars, the secondary locking mechanisms for mounting in the housing of FIG. 15**;

FIG. 17 is a top view of a tab terminal receiving housing; and

FIGS. **18*a*–18*h* are various secondary locking mechanisms with coding bars complementary to the coding bars of FIGS. 16*a*–16*h* respectively, the secondary locking mechanisms of FIG. 18 mountable to the tab housing of FIG. 17**.

DETAILED DESCRIPTION OF THE PREFERRED EMBODIMENT

Referring first to FIGS. 1–6, a connector assembly for receiving tab terminals therein comprises an insulative housing 4 and a secondary locking member 6. The housing 4 comprises a terminal mounting section 8 having tab terminal receiving cavities 10 extending axially therethrough from a mating face 12 to a terminal receiving face 14. A shroud 16 extends axially away from the terminal receiving face 14 and forms a cavity 18 therein for receiving the secondary locking member. A further shroud 20 extends axially from the mating face 12 and forms a cavity 22 therein for receiving a complementary connector assembly that will be described further on.

The terminal receiving section 8 comprises a centrally positioned coding cavity 24 that extends axially between the terminal receiving and mating faces 14,12 respectively.

The secondary locking mechanism 6 comprises a body section 26 extending axially between a terminal entry in 28 and a terminal locking face 30, and a coding bar 32 that extends axially from the locking face 30 to a mating end 34. The locking bar 32 is prismatic and may be comprised of more than one prismatic bar member, for example two as shown in FIGS. **18*e*–18*h* whereby the two coding bar members are denoted 32' and 32". The secondary locking member 6 is mountable to the housing 4 by insertion of the coding bar 32 into the housing coding cavity 24 and simultaneous insertion of the body section 26 into the cavity 18. Full insertion is achieved when the secondary locking member locking face 30 abuts the terminal receiving face 14 of the housing 4 and simultaneously locking protrusions 36 on side faces 38 of the body section 26 engage in latching windows 40 cut out of the shroud 16. The windows 40 have a sufficient width W transverse to the axial direction, to allow transverse sliding of the protrusions 36** for the reasons described herebelow.

Interengagement of the protrusions 36 and windows 40 enable retention of the secondary locking member 6 to the housing 4 in a preassembly position such that terminals (not shown) can be inserted through cavities 40 of the secondary locking member body section 6 and then into the housing cavities 10 for locking therein. Once all the terminals have been inserted into the housing cavities 10, the secondary locking member 6 can then be moved in the direction D perpendicular to the axial direction such that locking wall portions 42 that bound the cavities 40 project over edges 44 of the housing cavities 10, thereby projecting behind shoulders of terminals for axial retention thereof within the cavities 10. The secondary locking mechanism has a protrusion 46 that engages in a cutout 48 of the shroud 16 for providing further axial retention of the secondary locking member with respect to the housing, when in the fully assembled position. At an opposing transverse end 50 is a nob 52 for depressing the secondary locking mechanism in the direction D from the preassembled to the fully assembled position.

The secondary locking member and the housing have complementary recesses and protrusions 52,54,56,58 at their abutting terminal receiving and locking faces 14,30 respectively, that inter-engage to ensure that the secondary locking member 6 is inserted correctly into the cavity 18. If it is not correctly inserted, for example at 180° rotation about the axial axis, then the raised portions 56 and 54 of the secondary locking member and housings 6,4 respectively will abut and prevent engagement of the latches 36 in the cutouts 40, thus ensuring that preassembly theretogether is not possible.

The coding bar 32 occupies some of the space within the coding cavity 24 of the housing 4, whereby the mating end 34 projects beyond the mating face 12 of the terminal receiving section 8.

Referring now to FIGS. 7–12, a complementary connector assembly for mating to the connector assembly of FIGS. 1–6 is shown comprising a housing 104 and a secondary locking mechanism 106. The complementary connector assembly has many similar features and functions as the connector assembly of FIG. 1–6 and these features will be denoted with the same number raised to 100. Similar features can be understood by making reference to the description of FIGS. 1–6. The housing 104 has a terminal receiving section 108 having cavities 110 extending therethrough between a terminal receiving face 114 and a mating face 112, the cavities 110 for receiving receptacle terminals for mating with tab terminals of the connector assembly 4,6. The outer periphery 60 of the terminal receiving section 108 is substantially the same prismatic shape as the cavity 20 of the shroud 22 and is receivable therein mating the connector assemblies 4,104. The housing 104 similarly has a shroud 116 extending axially from the terminal receiving face 114, forming a cavity 118 for receiving the secondary locking member 106 therein. The shroud 116 also has windows 140 for engagement with latch protrusions 136 of the secondary connector member, which is also slidable in the direction of arrow D from a preassembly to a fully assembled position. Similarly, in the pre-assembly position receptacle terminals can be inserted into their housing cavities 110, and once fully inserted the secondary locking member 106 can be shifted in the direction of arrow D which is transverse of the axial direction to lock the terminals therein with the locking wall edges 142. The secondary locking member 106 also comprises one or more coding bars 132 that extends axially in a prismatic shape from the locking end face 130 to a mating end 134. The mating end 134 of the coding bar 132 is however substantially flush with the mating face 112 of the housing 104 when assembled thereto.

The housing 104 also comprises an axially extending centrally positioned coding cavity 124 that is substantially aligned with the coding cavity 24 of the complementary connector housing 4 when the connector assemblies are coupled together. The coding bar 132 thus occupies some of the space of the coding cavity 124 when assembled thereto in a manner complementary to the coding bar 32 within the coding cavity 24, such that when the complementary assembly 104,106 is inserted into the shroud cavity 22 of the connector assembly 4,6, then the coding bar 32 is inserted into the coding cavity 124 of the complementary connector assembly 124. Full mating of the connector assemblies is complete when the mating faces 12,112 abut. The coding bar 32 of the connector assembly 4,6 thus projects beyond the housing mating face 12 and into the coding cavity 124 of the complementary connector housing 104 alongside and interleaving with the coding bar 132 which is also disposed within the coding cavity 124 of the complementary connector housing. The complementary prismatic profiles of the coding bars 32, 132 are made in such a way that if either of the secondary locking members 106 or 6 have not been moved into their fully assembled positions, the mating ends 134,34 of the coding bars abut each other and prevent coupling of the connector assemblies. The coding bars thus also have the function of preventing coupling of the connector assemblies if the secondary locking members are not properly engaged.

FIGS. **18*a*–18*h* show various coding bar shapes of the male terminal connector assembly 4,6 that are complementary to the coding bar profiles of FIGS. 16*a*–16*h* respectively. The connector housing 4 assembled with the secondary locking member 6 of FIGS. 18*a* will thus be matable (when fully assembled) to the complementary connector housing 104 assembled to the secondary locking member 106 of FIG. 16*a*, however they would not be matable with the complementary housing was assembled to any of the other secondary locking members of FIGS. 16*b*–16*h*. Only the combinations of secondary locking members 6,106 from FIGS. 18 and 16 having the same letter (e.g. 18*c* is complementary to 16*c***) enables those connector assemblies to be mated together.

The housing 4 may comprise axially extending coding recesses 70,72 on the shroud 20, complementary and cooperable with coding protrusions 74,76 extending longitudinally along the outer periphery 60 of the terminal receiving section 108 of the complementary housing 104. Coding combinations are thus created by varying the position and number of the complementary recesses and protrusions (70,72,74,76). The number of the latter coding possibilities thus multiplies with the number of coding combinations of the complementary coding bars 32,132, thus providing a great number of coding combinations. The housings 4,104 with matching coding can also be provided with various matching colours corresponding to the various matching coding combinations for easy distinction.

Due to the wide variety of complementary shapes that the interengaging coding bars 32,132 can take, a wide variation of coding possibilities are available. Furthermore, the coding bar of the male connector assembly 104,106 is well protected as it does not project beyond the mating face 112. The connector assembly for receiving tab terminals 4,6 has a shroud 20 that protects not only the tabs terminals from damage, but also the coding bar 32 that projects beyond the mating face 12. Due to the positioning of the coding bars on the secondary locking members and integral therewith, they cannot be lost. They also provide the double function of ensuring correct coupling of connector assemblies, and preventing coupling if the secondary locking members are not fully assembled to the housings. The secondary locking members can be injection moulded from plastics of different colours for each coding combination, whereby for example the complementary secondary locking members of FIGS. 18i aand 16*a* would have the same colour, thereby assisting the visual detection of connector assemblies for coupling together. As the coding bars are on the secondary locking housings, they cannot get lost, and furthermore due to their prismatic shape extending from the main body of the secondary locking member they can be easily injected with small modifications to the moulding dies without a redesign of the whole die. The number of coding combinations is greatly increased by providing further coding members on the housings (4,104). The latter can also be colour matched for easy visual detection. The coding bar 32 is positioned within the area surrounded by the shroud 20, and is assembled to the connector housing from a terminal receiving end. The latter allows the shroud 20 to remain unbroken around the periphery such that the inner surface of the shroud can be used as an effective sealing surface for sealing between the coupled connectors. The cutout 48 could be removed, and the latch cutouts 40 replaced with protrusions, and a seal positioned over the terminal receiving face of the secondary locking member 6 for effective sealing of the connector, if this was required.

Advantageously therefore, a large range of coding possibilities are provided in a robust, reliable and compact form. Additionally, the coding members accomplish the function of ensuring full assembly of the secondary locking members and prevent coupling of connector assemblies if this is not the case.

We claim:

1. A connector assembly comprising an insulative housing and a secondary locking member mountable securely thereto in a first pre-assembly position for insertion of terminals into cavities of the housing, said secondary locking member having locking wall projections at a front end thereof, the cavities extending in an axial direction between a mating face and a terminal receiving face of a terminal section of the housing, the secondary locking member movable in a direction D transverse to the axial direction to a second fully assembled position whereby said locking wall projections of the secondary locking member project over edges of the cavities thereby projecting behind shoulders of said terminals when said secondary locking member is in the second fully assembled position for locking the terminals in the housing cavities, wherein the secondary locking member comprises a coding bar extending axially from a locking end face thereof to a mating end, said locking end face neighboring said locking wall projections and mounted adjacent the terminal receiving face of the terminal section, and wherein the coding bar is insertable in a coding bar receiving cavity of the housing extending axially through the terminal section from said terminal receiving face to said mating face, the coding bar being interleavable with a complementary coding bar of a complementary connector assembly to allow coupling of specific matching coded connector assemblies when the secondary locking member is fully assembled to the housing.

2. The connector assembly of claim 1 wherein coding bar is prismatic.

3. The connector assembly of claim 1 wherein the housing comprises a shroud extending axially away from the terminal receiving face to form a cavity for receiving the secondary locking member therein when assembled thereto.

4. The connector assembly of claim 3 wherein the locking end face of the secondary locking member is mountable against the terminal receiving face of the housing, wherein the faces have complementary interengaging protrusions and recesses to prevent assembly of the secondary locking member to the housing unless correctly orientated with respect thereto.

5. The connector assembly of claim 4 wherein the coding cavity is centrally positioned within the terminal section.

6. The connector assembly of claim 1 wherein the mating end of coding bar projects beyond the mating face of the terminal section.

7. The connector assembly of claim 1 wherein the housing has a shroud extending axially from the mating face and forming a cavity for receiving a terminal section of a complementary connector therein.

8. The connector assembly of claim 1 wherein the coding bar has a length between the locking end face and the mating end such that the mating end will not substantially project beyond the mating face of the terminal section.

9. The connector assembly of any preceding claim characterized in that the insulative housing comprises axially extending coding recesses complementary and interengageable with axially extending coding protrusions of a complementary housing for further coding combinations.

10. A connector assembly comprising an insulative housing and a secondary locking member mountable securely thereto in a first pre-assembly position for insertion of terminals into cavities of the housing, said secondary locking member having locking wall projections at a front end thereof, the cavities extending in an axial direction between a mating face and a terminal receiving face of a terminal section of the housing, the secondary locking member movable in a direction D transverse to the axial direction to a second fully assembled position whereby said locking wall projections of the secondary locking member project over edges of the cavities thereby projecting behind shoulders of said terminals when said secondary locking member is in the second fully assembled position for locking the terminals in the housing cavities, wherein the secondary locking member comprises a coding bar having a prismatic shape extending axially from a locking end face thereof to a mating end, said locking end face neighboring said locking wall projections and is mountable against the terminal receiving face of the housing, wherein the faces have complementary interengaging protrusions and recesses to prevent assembly of the secondary locking member to the housing unless correctly orientated with respect thereto, said coding bar being insertable in a coding bar receiving cavity of the housing extending axially through the terminal section from said terminal receiving face to said mating face, the coding bar being interleavable with a complementary coding bar of a complementary connector assembly to allow coupling of specific matching coded connector assemblies only when the secondary locking member is fully assembled to the housing, the housing further comprising a shroud extending axially away from the terminal receiving face to form a cavity for receiving the secondary locking member therein when assembled thereto.

11. The connector assembly of claim 10 wherein the coding cavity is centrally positioned within the terminal section.

12. The connector assembly of claim 10 wherein the mating end of the coding bar projects beyond the mating face of the terminal section.

13. The connector assembly of claim 10 wherein the housing has a shroud extending axially from the mating face and forming a cavity for receiving a terminal section of a complementary connector therein.

14. The connector assembly of claim 10 wherein the mating end of the coding bar does not substantially project beyond the mating face of the terminal section.

15. The connector assembly of claim 10 characterized in that the insulative housing comprises axially extending coding recesses complementary and interengageable with axially extending coding protrusions of a complementary housing for further coding combinations.

* * * * *